United States Patent [19]

Blue

[11] 3,966,547

[45] June 29, 1976

[54] METHOD OF PRODUCING $^{123}$I

[75] Inventor: James W. Blue, Bay Village, Ohio

[73] Assignee: The United States of America as represented by the United States National Aeronautics and Space Administration, Washington, D.C.

[22] Filed: Mar. 13, 1973

[21] Appl. No.: 340,863

Related U.S. Application Data

[63] Continuation-in-part of Ser. No. 247,434, April 25, 1972, abandoned.

[52] U.S. Cl. ..... 176/11; 176/16; 423/249

[51] Int. Cl.$^2$ ..... G21G 1/10

[58] Field of Search ..... 176/11, 16; 423/249

[56] References Cited

UNITED STATES PATENTS

| | | | |
|---|---|---|---|
| 2,795,482 | 6/1957 | McNabney | 423/249 |
| 3,018,159 | 1/1962 | Silverman | 423/249 |
| 3,694,313 | 9/1972 | Blue et al. | 176/16 |

OTHER PUBLICATIONS

J. Inorg. Nucl. Chem., vol. 28, No. 3, Mar. 1966, pp. 771–794, by Rudstam et al.

Isotopes and Radiation Technology, vol. 4, No. 3, 1967, pp. 275–280, by Rhodes et al.

Uses of Cyclotrons in Chem., Metallurgy and Biology, Proc. Conf., Sept. 1969, pp. 138–148, Blue et al. (II).

Bulletin of the Chemical Society of Japan, Feb., 1970, vol. 43, No. 2, p. 576, Kato et al.

*Primary Examiner*—Harvey E. Behrend

*Attorney, Agent, or Firm*—N. T. Musial; G. E. Shook; John R. Manning

[57] ABSTRACT

Bombarding a cesium heat pipe with high energy particles causes a spallation reaction which produces vapors of $^{123}$Xe and contaminants. The contaminants are removed in a dry ice cold trap while the $^{123}$Xe condenses in a liquid nitrogen trap where it decays to $^{123}$I.

5 Claims, 1 Drawing Figure

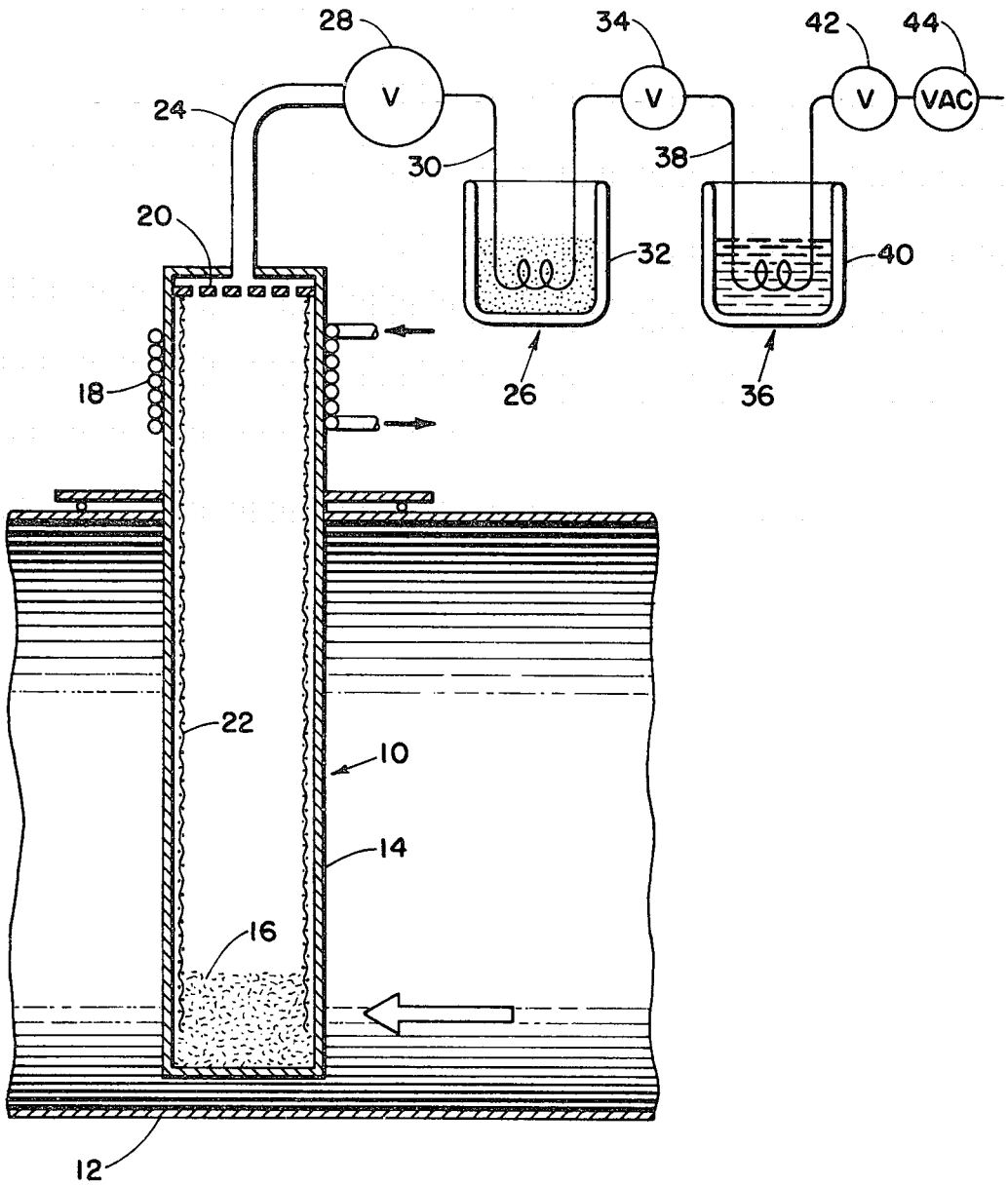
28
34
42
44
V
V
V
VAC
24
30
38
20
32
40
18
26
36
22
10
14
16
12

METHOD OF PRODUCING $^{123}I$

ORIGIN OF THE INVENTION

The invention described herein was made by an employee of the United States Government and may be manufactured and used by or for the Government for governmental purposes without the payment of any royalties thereon or therefor.

STATEMENT OF COPENDENCY

This application is a continuation-in-part of application Ser. No. 247,434 which was filed Apr. 25, 1972, now abandoned.

BACKGROUND OF THE INVENTION

This invention is concerned with the production of high purity radioiodine for thyroid measurements and as a general radionuclide. The invention is particularly directed to the utilization of a heat pipe in the production of radioisotopes using very intense particle accelerators.

Radioactive iodine is used for medical diagnostic studies. The isotope $^{131}I$ has been used for this purpose because of its availability. The radioisotope $^{123}I$ is considered much superior to the $^{131}I$ in studies where the amount of radiation exposure to a patient is of prime concern. Because of the shorter half-life and the decay by electron capture, the radiation exposure received by the patient from $^{123}I$ is about 1/40th that of an equal amount of $^{131}I$.

$^{123}I$ is also superior to $^{131}I$ because the gamma ray energy of $^{123}I$ is 159 KEV compared to 364 KEV of $^{131}I$. Collimators operate more effectively with this lower energy. Also the collimators used with $^{123}I$ are less bulky.

A method of $^{123}I$ production is disclosed in U.S. Pat. No. 3,694,313. The method disclosed in this patent has been quite successful in terms of freedom from radioactive impurities. However, the method is not capable of handling the power densities involved in using high energy, high current machines.

SUMMARY OF THE INVENTION

According to the present invention cesium is used both as the working fluid of a heat pipe and as the target material for high energy protons. A spallation reaction produces $^{123}Xe$ and many radioactive contaminants which pass from the heat pipe to low-temperature traps where the undesirable contaminants are removed. The xenon is held for a period of time sufficient for it to decay to $^{123}I$.

OBJECTS OF THE INVENTION

It is, therefore, an object of the invention to provide a method of producing the radioisotope $^{123}I$ with high energy particles from very intense particle accelerators.

Another object of the invention is to provide a method of producing $^{123}I$ using a heat pipe that is bombarded with high energy particles.

These and other objects of the invention will be apparent from the specification which follows and from the drawing wherein like numerals are used throughout to identify like parts.

DESCRIPTION OF THE DRAWINGS

The drawing is a schematic view of an apparatus for producing radioactive iodine in accordance with the invention.

DESCRIPTION OF THE PREFERRED EMBODIMENT

Referring now to the drawing there is shown a target assembly 10 which extends into a beam duct 12 of a high energy accelerator. It is contemplated the target assembly 10 may be used with the LOS ALAMOS MESON FACILITY, known as LAMF. Another high energy accelerator located in Canada, called TRIUMF, would be a suitable source of high energy particles. The beam in the duct 12 from such accelerators is characterized by high energy and high current.

The target assembly 10 is in the form of a heat pipe which comprises a tubular container 14 having a supply 16 of cesium −133 in the end which extends into the beam duct 12. The opposite end of the tube 14 which protrudes from the duct 12 is surrounded by cooling coils 18. A suitable cooling fluid, such as water, is circulated through the coils 18.

A porous metal plug 20 is mounted in the container 14 adjacent the cooling coils 18. A wick 22 extends along the inner wall of the tube 14 between the plug 20 and the cesium 16.

A tube 24 connects the inside of the container 14 to a cold trap 26 through a valve 28. Tygon tubing has been satisfactory for the tubular conduit 24. The cold trap 26 comprises a U-tube 30 immersed in a coolant in an insulated container 32. A ¼ inch copper U-tube surrounded by solid $CO_2$ in a Dewar has been satisfactory. The dry ice maintains a trap 26 at a temperature of −79°C.

A valve 34 connects the dry ice trap 26 to a second cold trap 36. A ¼ inch copper U-tube 38 immersed in liquid nitrogen in a Dewar 40 has been satisfactory for the cold trap 36. The liquid nitrogen maintains the trap 36 at a temperature of −196°C. A valve 42 is used to isolate the trap 36 or connect it to a vacuum pump 44.

In operation, a beam of high energy protons identified by the arrow in the duct 12 penetrates the tubular container 14 and strikes the cesium −133 in the target assembly 10. The beam penetrating the cesium causes what is known in nuclear physics as a spallation reaction which produces $^{123}Xe$ according to the reaction $^{133}Cs$ (p,p 10n)$^{123}Xe$.

This is only one of a number of reactions that lead to significant impurities. Some of these reactions are $^{133}Cs$ (p, 2p 8n)$^{124}I$, $^{133}Cs$ (p, 2p 7n)$^{125}I$, $^{133}Cs$ (p, 2p 6n)$^{126}I$, $^{133}Cs$ (p, 3p 8n)$^{123}Te$, $^{133}Cs$ (p, 4p 6n)$^{124}Sb$.

To produce these spallation reactions the incident proton must have an energy greater than 200 MeV. The first three reactions produce the radioactive iodines $^{124}I$, $^{125}I$ and $^{126}I$. These radioactive iodines would seriously contaminate the desired $^{123}I$ because they cannot be chemically separated. The other impurities formed by the above listed reactions could be separated chemically because they are different elements. However, this is not necessary in the heat pipe device because all of the impurities have a lower vapor pressure than a desired $^{123}Xe$ and can be collected on cool surfaces at the heat rejection end of the heat pipe. Radioactive isotopes of iodine, tellurium, antimony, tin, indium, and cesium are all contaminants.

All of the isotopes of hydrogen and helium could be accelerated to hundreds of MeV and produce the desired spallation reaction. An example would be $^{133}Cs(\alpha, 3p\ 11n)^{123}Xe$. The same contaminants as produced by proton bombardment would also be produced.

The beam penetrating the cesium −133 deposits energy in the cesium that heats this target to the point where it vaporizes. All charged particle beams lose energy by ionizing and exciting electrons on the atoms of the stopping material, such as cesium. The individual particles that make up the beam actually lose velocity in a continuous manner. This energy lost by the beam appears as heat, and if the beam current is large enough that heat will melt metallic cesium and vaporize it. The vapor is transported to the end of the tubular chamber 14 where it is cooled by the cooling coils 18. The temperature at the hot end of the heat pipe is the boiling point of cesium, i.e. 670°C, and the temperature at the cold end would be above the melting point. The cesium condenses at this cool end of the tube. The beam power that was deposited in the cesium is rejected to the coolant that flows in the coils 18.

Some small amount of cesium vapor may be transported through the plug. However, most of the cesium vapor will be collected on the cool walls because the vapor has a greater opportunity to contact the cool walls than the plug. The $^{123}Xe$, $^{125}Xe$, $^{123}I$, $^{124}I$, $^{125}I$, $^{126}I$, and $^{129}I$ will pass through the plug plus smaller amounts of other contaminants. All these elements passing the plug will be subsequently stopped by cooler surfaces except for xenon. Xenon will not be collected until it is pure and free of contaminants.

The $^{123}Xe$ and other volatile contaminants also travel to the cool end of the tube 14 where they pass through the tube 24 and valve 28 to the cold trap 26. The porous metal plug 20 prevents accidental transport of liquid cesium into the trap 26 which might take place where boiling occurs. The vapors of radioactive contaminants condense in the trap 26.

The $^{123}Xe$ is still a vapor and passes to the trap 36 at liquid nitrogen temperature. The $^{123}Xe$ condenses in the trap 26. The removal of the xenon from the vapor phase produces a pumping action that causes almost all the xenon that is produced to be transported to the trap 36.

The cesium vapors that condense in the heat pipe at the coils 18 are transported back to the target area by capillary action of the wick 22. It is also contemplated that grooves in or on the inner wall of the tubular container 14 may be used to transport the condensed cesium vapors back to the target area.

It is apparent the target assembly 10 uses cesium as both a heat pipe working material and as a target material for the production of radioisotopes by high energy charged particles. Cesium —133 is the preferred working material because of the uniqueness of its heat transfer properties, such as enthalpy, melting point, boiling point and vapor pressure-temperature curve. No other element has these properties together with the nuclear requirements as required by the target material.

Although the preferred embodiment has been shown and described it is contemplated that various structural modifications may be made to the disclosed apparatus without departing from the spirit of the invention or the scope of the subjoined claims. By way of example, it is contemplated that different trap configurations could be utilized. The trap 26 could be a chemical trap, like hot silver, to remove radioiodine impurities. The $^{123}Xe$ trap 36 could work on the absorption principle. The trap 34 could also contain a pharmaceutical compound that would become tagged or labeled when the xenon decays to iodine.

What is claimed is:

1. In a method of producing high purity radioactive $^{123}I$ by the decay of $^{123}Xe$, the improvement comprising the steps of bombarding $^{133}Cs$ contained in one end of a heat pipe with a beam of high energy protons having energies greater than 200 MeV causing a spallation reaction which produces xenon vapor and radioactive iodine contaminants while heating said $^{133}Cs$ and vaporizing the same, transporting said vaporized $^{133}Cs$ out of said beam to the end of said heat pipe opposite said beam, cooling said end of said heat pipe opposite said beam so that said vaporized $^{133}Cs$ condenses, transporting said condensed $^{133}Cs$ back to said one end of said heat pipe in said beam for additional bombardment, removing said radioactive iodine contaminants and said xenon vapor from said cooled end of said heat pipe, separating said radioactive iodine contaminants from said xenon vapors, condensing said xenon vapor in a container after said radioactive iodine contaminants have been removed therefrom, and holding the xenon in said container for a period of time sufficient for $^{123}Xe$ to decay $^{123}I$.

2. A method of producing high purity radioactive $^{123}I$ as claimed in claim 1 including freezing said contaminants in a cold trap.

3. A method of producing high purity radioactive $^{123}I$ as claimed in claim 2 including directing the $^{123}Xe$ vapor and contaminants into a dry ice cold trap.

4. A method of producing high purity radioactive $^{123}I$ as claimed in claim 3 including the step of directing the $^{123}Xe$ vapor to a container cooled by liquid nitrogen after passage through the dry ice cold trap.

5. A method of producing high purity radioactive $^{123}I$ as claimed in claim 1 including the step of holding the $^{123}Xe$ in said container for a period of about 4 to 8 hours.

* * * * *